US005681128A

United States Patent [19]

Morgan et al.

[11] Patent Number: 5,681,128

[45] Date of Patent: Oct. 28, 1997

[54] SURFACE MARKING SYSTEMS

[75] Inventors: Noredin Morgan, Billerica; Ernest P. Liporto, North Andover, both of Mass.

[73] Assignee: Illinois Tool Works Inc., Glenview, Ill.

[21] Appl. No.: 391,215

[22] Filed: Feb. 21, 1995

[51] Int. Cl.[6] ..... E01F 9/06

[52] U.S. Cl. ..... 404/12; 404/15; 156/330

[58] Field of Search ..... 404/9–16, 77, 404/79, 94, 95; 156/330

[56] References Cited

U.S. PATENT DOCUMENTS

| | | | |
|---|---|---|---|
| 3,011,412 | 12/1961 | Harrington et al. | 94/1.5 |
| 4,146,635 | 3/1979 | Eigenmann | 428/283 |
| 4,185,132 | 1/1980 | Gurney | 427/137 |
| 4,195,945 | 4/1980 | Heenan | 404/16 |
| 4,203,878 | 5/1980 | Bauer | 260/18 EP |
| 4,208,090 | 6/1980 | Heenan | 350/61 |
| 4,500,703 | 2/1985 | Guthrie et al. | 523/400 |
| 4,846,905 | 7/1989 | Tarbutton et al. | 525/65 |
| 5,001,193 | 3/1991 | Golden | 525/109 |
| 5,078,538 | 1/1992 | Montalbano | 404/9 |
| 5,277,513 | 1/1994 | Flanagan | 404/16 |
| 5,419,651 | 5/1995 | Fei | 404/14 |
| 5,453,450 | 9/1995 | Kinzer et al. | 522/18 |

*Primary Examiner*—James Lisehora

*Attorney, Agent, or Firm*—Synnestvedt & Lechner

[57] ABSTRACT

Disclosed are surface markings systems and methods of producing such systems in which the marker is at once permanently and strongly affixed to the surface during normal use thereof but efficiently and economically removable from the surface during repair or recycling operations. The preferred systems utilize a reactive adhesive which, when cured, has a lap shear strength of at least about 1000 psi at about 25° C. and a lap shear strength of about 50 psi or less at least one temperature in the temperature range of from about 70° C. to about 180° C. The use of curable epoxy adhesives is described.

23 Claims, 3 Drawing Sheets

SURFACE MARKING SYSTEMS

FIELD OF THE INVENTION

The present invention relates to surface marking systems and more particularly to repairable surface marking systems especially adapted for use as pavement marking systems.

BACKGROUND OF THE INVENTION

Marking systems are frequently employed on roadways and walkways, and in construction areas and the like to help guide the users of such facilities along the proper path of travel. Such systems typically include surface markers which provide indicia to be sensed by the user of the particular facility. For example, it is common in many modern highway systems to employ a series of markers having reflective or other visually prominent features to separate one lane of travel from another while also providing a series of bumps or protrusions in the road surface separating such lanes of travel. Because the protruding portion of such markers are frequently exposed to high impact forces, such as from the tires of vehicles traveling on the roadway, it is extremely important that such markers be firmly and strongly joined to the roadway. Such a requirement ensures that the markers are not dislodged during normal use. For obvious reasons, this requirement is especially important in connection with road surfaces that are expected to undergo snow and ice removal operations.

In order to ensure that such markers are not prematurely or inadvertently dislodged from the roadway surface, the prior art has heretofore emphasized installing such markers with adhesive formulations of high strength and durability. For example, U.S. Pat. No. 5,078,538—Montalbano indicates that reactive epoxy-type adhesives are especially effective for the installation of markers in concrete road surfaces.

One significant disadvantage of heretofore known highway marking systems which utilize a reactive adhesive, such as epoxy, has been the failure of such systems to allow effective repair and/or replacement of the marker. For example, in certain states removal of old levels of the roadway for repaving, such as by stripping or scarfing, is necessary from time to time. In such circumstances, it is desirable to provide a marking system in which the markers can be efficiently removed from the road surface and recycled for further use. Furthermore, many applications require that the marking system comprise a relatively temporary installation, such as in construction zones. In such temporary installations, it is also highly desirable that the markers can be removed and recycled for further use.

It has heretofore been generally accepted that reactive adhesives, such as epoxies, were not adaptable for use in systems requiring efficient and economical removal, replacement, repair and/or recycling of the individual markers. For example, the Montalbano patent indicates that epoxy adhesives cannot be used in temporary installations because such epoxy-installed markers cannot be removed without tearing up the roadway (col. 2, lines 24–30). The Montalbano patent also notes that another adhesive used for highway marker systems, namely, bituminous adhesive, is also less than fully satisfactory because of the flexibility associated with such adhesive materials (col. 2, lines 32–39).

Other disadvantages are generally associated with prior road-surface marking systems. For example, many prior systems are limited to installation only during seasons in which the ambient temperature is sufficiently high. Accordingly, applicants have recognized a need for a marking system which can be effectively installed without regard to ambient temperature conditions. Another disadvantage of many prior systems is that the time required for functional installation is undesirably long. This is especially detrimental in road repair situations because a major objective in such cases is to minimize the down-time for the roadway.

SUMMARY OF THE INVENTION

In view of the deficiencies and failures of the prior art, it is an object of the present invention to provide surface marking systems and methods of producing such systems in which the marker is at once permanently and strongly affixed to the surface during normal use thereof but efficiently and economically removable from the surface during repair or recycling operations.

It is a further object of the present invention to a provide surface marker system which utilizes a reactive adhesive that is efficiently and economically debonded.

Applicants have found that these and other objects are achieved by providing surface marking systems which include the surface to be marked, a marker for the surface, and a reactive adhesive composition bonding the surface marker to the surface. According to preferred systems, the reactive adhesive when cured has a lap shear strength of at least about 1000 psi at about 25° C. and a lap shear strength of about 500 psi or less at least one temperature in the temperature range of from about 70° C. to about 180° C. According to preferred embodiments, the surface marking system comprises a roadway marking system wherein the pullout force of the marker is at least about 2000 lbs. at about 25° C. and about 1000 lbs. or less at at least one temperature in the temperature range of from about 70° C. to about 180° F. According to especially preferred embodiments, the reactive adhesive comprises an induction curable epoxy adhesive.

The present invention also provides methods of forming a repairable surface marking system comprising the steps of providing a surface portion adapted to adhesively mount the marker, providing a reactive adhesive composition between the surface portion and at least a portion of the marker, and then curing the reactive composition to form a cured composition adhesively bonding the marker to the surface. In accordance with preferred embodiments of this aspect of the invention, the lap shear strength of the cured adhesive is at least about 1000 psi at about 22° C., while the lap shear strength of the adhesive at at least one temperature in a temperature range of from about 70° C. to about 180° C. is about 500 psi or less.

DETAILED DESCRIPTION

I. THE SYSTEMS

The systems in accordance with the present invention generally comprise three essential components: a surface to be marked; a surface marker; and a cured adhesive composition bonding the marker to the surface. For the purpose of convenience, the features and characteristics of each of these components are described under separate topic headings below. It will be appreciated, however, that this form of presentation is for convenience only and that the scope and nature of the present invention resides in the combination of these components as defined by the claims appended hereto.

A. The Surface

In view of the disclosure and teachings contained herein, those skilled in the art will recognize that the present invention is readily adaptable for use in connection with a wide variety of surfaces to be marked. In general, however, the preferred surface comprises the surface of a relatively immobile structure. For example, the surface to be marked in accordance with the preferred aspects of the present invention includes both permanent and temporary roadway and walkway surfaces. In addition, it is contemplated that the present invention may be beneficially used in connection with the marking of construction barriers and the like.

The preferred surfaces of the present invention are surfaces formed from relatively hard, wear-resistant materials, such as asphalt, concrete, brick, wood, metal, plastic and the like.

B. The Markers

Figure 1:
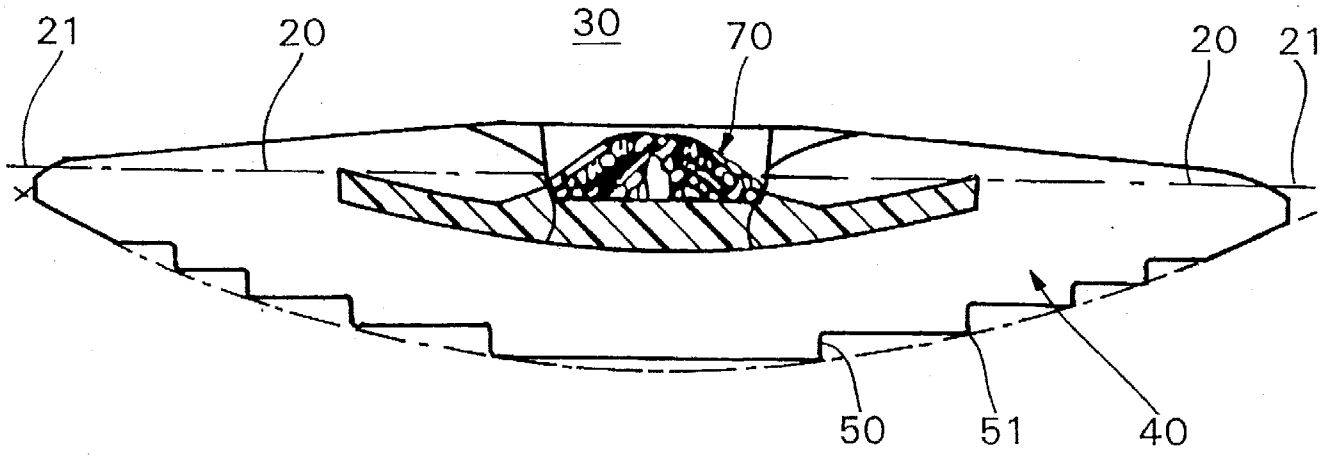
FIG. 1 is a cross-sectional view of a road marking system in accordance with one embodiment of the present invention.

Surface markers having a wide variety of configurations and constructions, and formed from a wide variety of materials, are known and available to those skilled in the art, and it is contemplated that all such surface markers are adaptable for use in connection with the present invention. The present invention is especially well-adapted, however, for use in connection with road surface markers of the type which are at least partially embedded in the road surface. Such markers are commonly used in connection with the provision of snow plowable pavement markers of the type illustrated in FIG. 1 hereof. In use, the pavement marker 30 is fixedly embedded in the pavement 20 of a roadway so as to project above the pavement surface 21 and be visible from oncoming vehicles traveling in either direction along the roadway. Such a pavement marker includes a base member, generally designated as 40, which is formed of a relatively high strength material, such as prolitic ductile iron. The base member supports thereon a retro reflector, designated generally as 70. Snow plowable pavement markers of this type are described in detail in U.S. Pat. Nos. 4,195,945 and 5,277,513, each of which is incorporated herein by reference. The bottom surface of the marker 30 includes step portions 50 which define a plurality of tooth-like points 51 and which function to retard slipping or shifting of the base member 40 with respect to pavement 20 when installed with the adhesive component of the present invention. The adhesive (not shown for convenience of illustration) is located between the bottom portion of the marker base 40, and the surface of the cut-out portion of the roadway.

Figure 2:
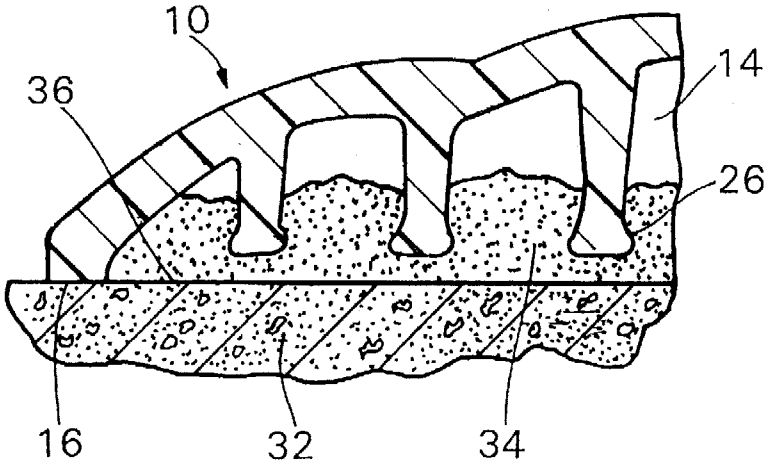
FIG. 2 is a cross-sectional view of another embodiment of a road marking system in accordance with the present invention.

It is also contemplated that the present invention is adaptable for use in connection with roadway markers that are not embedded in the roadway pavement but rather are adhesively fixed directly to the traffic-bearing surface of the roadway. A marker of this type is illustrated in FIG. 2. The illustrated marker is exemplary of markers commonly used as temporary or construction zone markers intended to be installed for relatively short periods of time where rerouting of traffic may be required. Markers of this general type are described in detail in U.S. Pat. Nos. 4,208,090 and 5,078,538, each of which is incorporated in its entirety herein by reference.

The highway marker illustrated in FIG. 2, which is indicated generally as 10, includes downwardly depending wall portions 14 adapted to accept the adhesive and increase contact between the marker 10 and the roadway surface 36. Each wall preferably includes outwardly displaced flanges 26 which assists in positive interlock between the highway marker 10 and the adhesive material 34.

C. The Reactive Adhesive An important and critical aspect of the systems in accordance with the present invention is the provision of a reactive adhesive having temperature-dependent strength properties that fall within certain preferred values. As used herein, the term "reactive adhesive" refers to adhesive compositions which develop bonding properties as a result of curing or some other form of reaction mechanism. By way of contrast, thermoplastic or "hot melt" adhesive compositions are not reactive adhesives as that term is used herein.

Applicants have discovered that cured adhesives can be formulated to have shear strength properties that enable the maintenance of a high strength, durable bond of the marker to the surface at operating temperatures while being debondable at moderately elevated temperature conditions. For embodiments in which the surface marking system comprises a roadway marking system, the preferred surface operating temperature range is from about −40° C. to about 50° C. As used herein, the term "moderately elevated temperature" refers to temperatures which are above about the upper end of the surface operating temperature range and preferably no greater than about 400 percent above the upper end of the surface operating temperature range. Applicants have found that the formulation and use of such reactive adhesive compositions makes it possible to form surface marking systems which perform exceptionally well in even the severest of normal use conditions while possessing the ability to debond effectively, efficiently and economically. It will be appreciated by those skilled in the art that while such a combination of properties is highly desirable, it has not been available in prior roadway marking systems.

Applicants have found that the use of a reactive adhesive having a lap shear strength of at least about 1000 psi at about 25° C. is generally capable of producing a bond between a roadway marker and the roadway surface that is sufficiently strong to ensure that the marker remains intact during normal use, including any required snow or ice removal operations. A surprising and unexpected aspect of applicants' discovery, however, is that such reactive adhesives can be formulated to undergo a substantial decline in strength properties in a temperature range of from about 70° C. to about 180° C. Such a property has exceptional advantage in connection with the present invention insofar as it provides the capability of using efficient and economical mechanisms and techniques to "debond" the adhesive such that the marker may be easily removed from the surface. More specifically, the reactive adhesives of the present invention are preferably characterized by a lap shear strength of at least about 1000 psi at about 22° C., and preferably over the entire range of temperatures of from about −40° C. to about 50° C., while also possessing a lap shear strength of less than about 500 psi, and even more preferably less than about 250 psi, at at least one temperature in the temperature range of from about 70° C. to about 180° C. Unless otherwise indicated herein, the reference to the strength properties of the reactive adhesive refers to the property of the adhesive after the adhesive has been cured. Furthermore and unless otherwise indicated, the lap shear strength values described and reported herein refer to the lap shear strength as determined in accordance with ASTM-D 1002.

Figure 3:
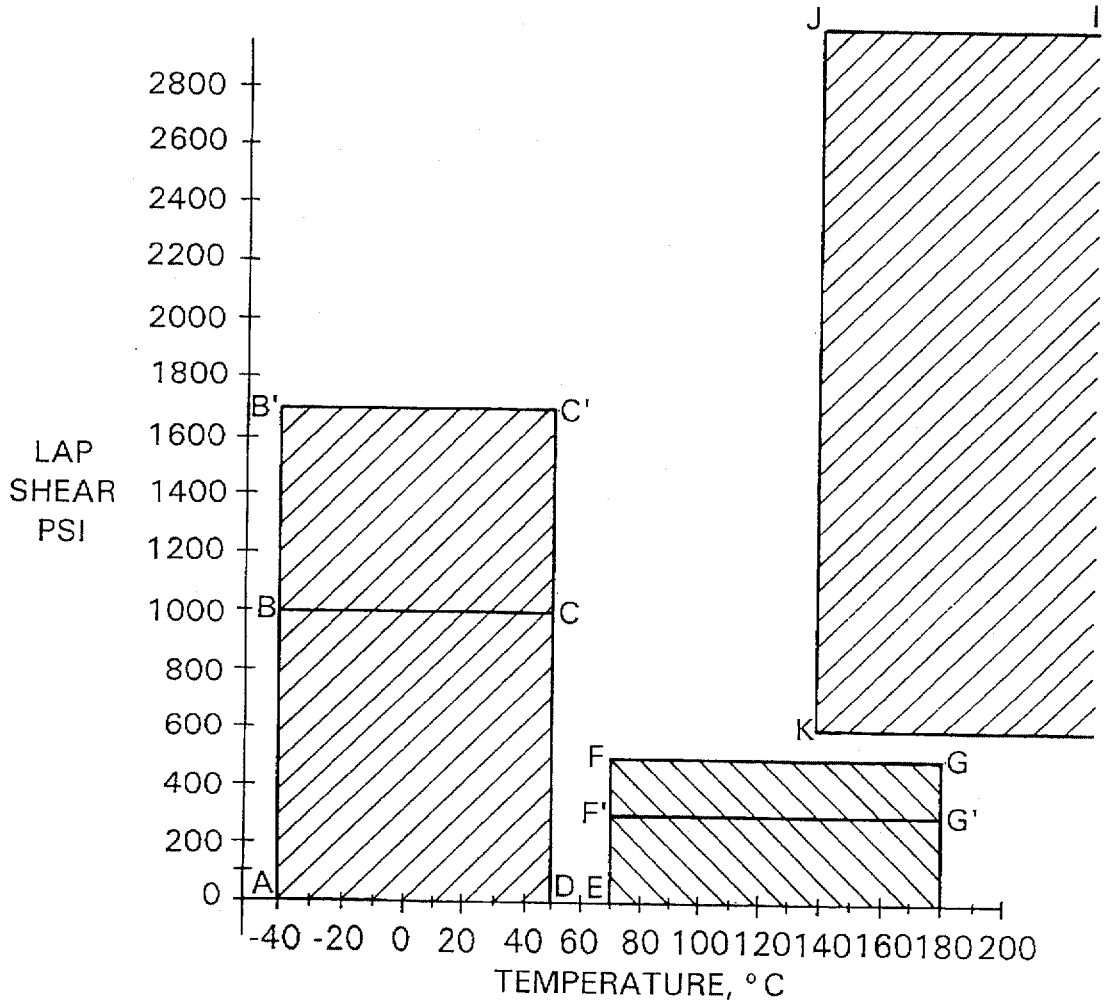
FIG. 3 is a graphical representation showing the preferred temperature dependent performance characteristics of the adhesives in accordance with the present invention.

The requirements of the temperature/strength curve of such preferred composition is illustrated in connection with FIG. 3. Applicants have found that the reactive adhesives hereof are preferably formulated such that (1) no portion of the temperature/strength curve is within the cross-hatched region bounded by the lines ABCD and (2) at least a portion the curve is within the shaded region bounded by the lines EFGH. According to certain preferred embodiments, the reactive adhesives are formulated such that (1) no portion of the temperature/strength curve is within the cross-hatched region bounded by the lines AB'C'D and (2) at least a portion the curve is within the shaded region bounded by the lines EF'G'H. According to yet further preferred embodiments, the reactive adhesives are also formulated such that no portion of the temperature/strength curve is within the cross-hatched region bounded by the lines IJKL. Applicants have found that by formulating a reactive adhesive to have a temperature/strength profile that is restricted in this way, the strength of the bond is sufficiently high under temperature conditions extant during normal use (i.e., over the surface operating temperature range) to prevent premature dislodgement of the marker. At the same time, the above noted restrictions require that the cured adhesives undergo a rapid and step decline in strength as the temperature of the adhesive is moderately elevated outside the surface operating range.

Figure 4:
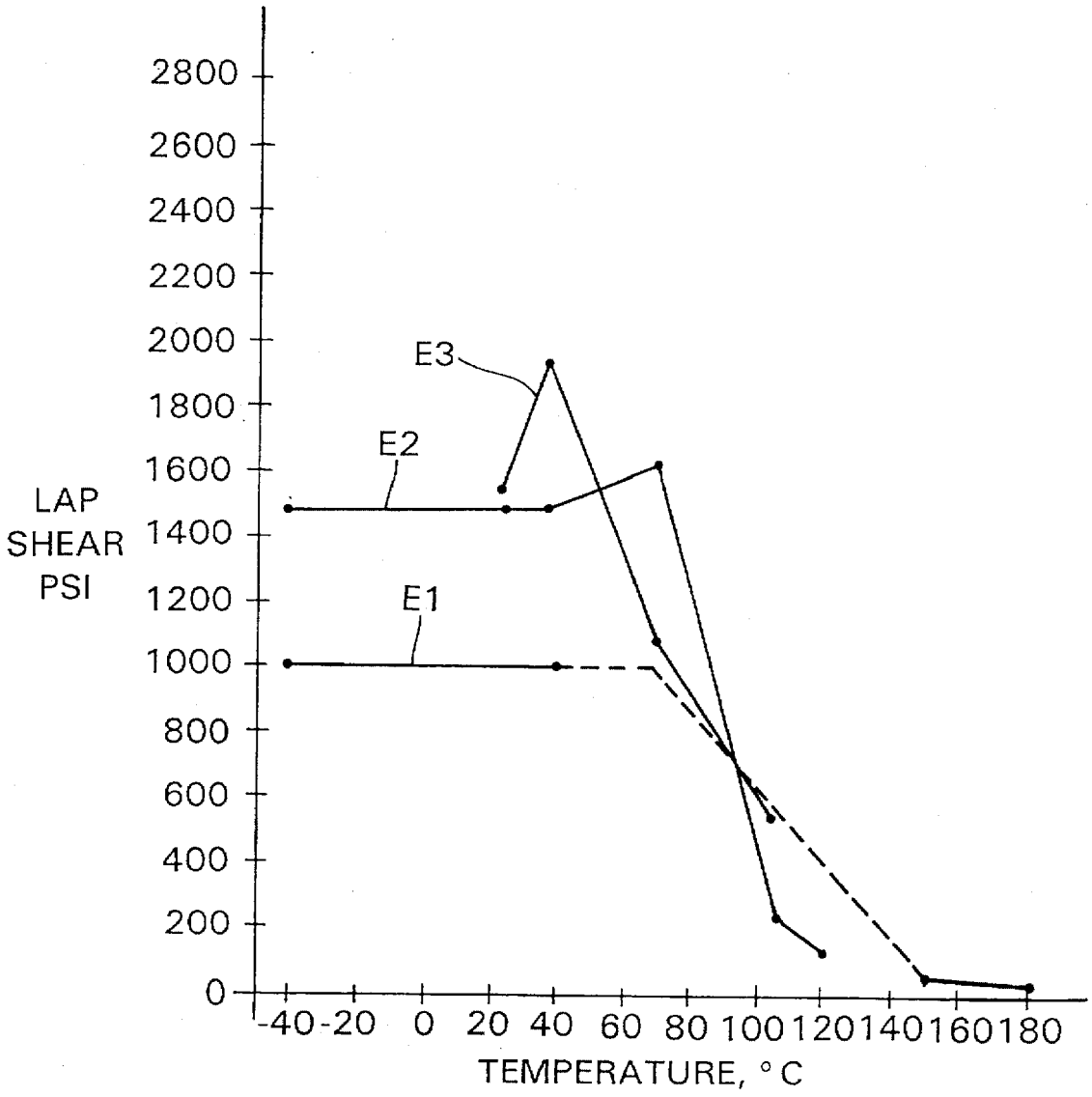
FIG. 4 is a graphical illustration showing the temperature dependent adhesive characteristics of three embodiments in accordance with the present invention.

The unique property described above has exceptional advantage in connection with the present invention insofar as it provides the capability of using efficient and economical mechanisms and techniques to "debond" the adhesive such that the marker may be easily removed from the surface, especially road surface markers used in connection with concrete and asphalt pavement. The adhesives of the present invention thus have strength/temperature profiles of the type illustrated as E1–E3 in FIG. 4 and as discussed more fully in connection with Example 4 hereinafter.

It is contemplated that the reactive adhesive in accordance with the present invention may incorporate numerous and varied types and amounts of components, including both reactive and inert components. For example, it is contemplated that the reactive adhesive of the present invention may generally comprise a polyurethane based adhesive, an epoxy resin based adhesive, a polysulfide adhesive, reactive acrylate adhesives, polyester vinyl acetate, combinations of one or more of the above reactive adhesive components with nonreactive adhesive components, and combinations of two or more of such reactive adhesives. Nevertheless, it is generally preferred that the reactive adhesive systems in accordance with the present comprise epoxy adhesive.

In general, the epoxy adhesives of the present invention comprise epoxy resin and a curing agent for the epoxy resin. As used herein, the term "curing agent" refers to one or more components which are capable of catalyzing and/or accelerating the crosslinking reaction of the epoxy component. It is contemplated that the relative proportion of epoxy resin to curing agent may vary widely within the scope hereof in order to accommodate the needs and requirements of any particular application. In general, however, it is preferred that the reactive composition of the present invention comprise from about 22 to about 38 parts by weight (PBW) of epoxy resin and from about 20 to about 40 PBW of curing agent.

As used herein, the term "epoxy resin" refers to compounds containing a reactive oxirane ring in the molecular structure. It is contemplated that both bisphenol A epoxies (bis A) and aliphatic epoxies may be utilized in accordance with the present invention. As is known to those skilled in the art, bis A epoxies are based upon the condensation reaction of bisphenol A and epichlorohydrin to produce a diglycidyl ether of bisphenol A. Particularly preferred bis A epoxy resins are available commercially from Shell Oil Co. under the family trade designation EPON, with EPON 828 being especially preferred.

It is further contemplated that epoxy resins having a wide range of molecular weights and other characteristics are adaptable for use in accordance with the present invention. It is generally preferred, however, that the epoxy resins of the present invention possess an epoxy equivalent weight (EEW) of from about 180 to about 192. Furthermore, it is generally preferred that the epoxy resins have a viscosity of from about 11,000 to about 14,000 cps at about 25° C.

The epoxy resins suitable for use in the present invention may thus comprise one or more compounds, such as epoxy prepolymers, having more than one epoxide group per molecule available for reaction with the curing agent of the present invention. Such epoxy prepolymers include but are not limited to polyglycidyl ethers of polyvalent phenols, for example pyrocatechol, resorcinol, hydroquinone; 4,4'-dihydroxydiphenyl methane; 4,4'-dihydroxy-3-3'-dimethyldiphenyl methane; 4,4'-dihydroxydiphenyl dimethyl methane; 4,4'-dihydroxydiphenyl methyl methane; 4,4'-dihydroxydiphenyl cyclohexane; 4,4'-dihydroxy-3,3'-dimethyldiphenyl propane; 4,4'-dihydroxydiphenyl sulfone; or tris-(4-hydroxyphenyl)methane; polyglycidyl ethers of novalacs (i.e., reaction products of monohydric or polyhydric phenols with aldehydes, formaldehyde in particular, in the presence of acid catalysts); polyglycidyl ethers of diphenols obtained by esterifying 2 mols of the sodium salt of an aromatic hydrocarboxylic acid with 1 mol of a dihaloalkane or dihalogen dialkyl ether; and polyglycidyl ethers of polyphenols obtained by condensing phenols and long-chain halogen paraffins containing at least two halogen atoms.

Other suitable compounds adaptable for use as the epoxy resin include polyepoxy compounds based on aromatic amines and epichlorohydrin, for example N,N'-diglycidyl-aniline; N,N'-dimethyl-N,N'-diglycidyl-4,4'-diaminodiphenyl methane: N,N,N',N'-tetra glycidyl-4,4'-diaminodiphenyl methane; and N-diglycidyl-4-aminophenyl glycidyl ether.

Glycioyl esters and or epoxycyclohexyl esters of aromatic, aliphatic, aliphatic and cycloaliphatic polycarboxylic acids, for example phthalic acid diglycidyl esters and adipic diglycidyl ester and glycidyl esters of reaction products of 1 mol. of an aromatic or cycloaliphatic dicarboxylic acid anhydride and 1,2 mole of a diol or 1 n mol of a polyol with n hydroxyl groups, of hexahydrophthalic acid diglycidyl esters, optionally substituted by methyl groups, are also suitable for use as the epoxy resin.

Glycidyl ethers of polyhydric alcohols, for example of 1,4-butanediol; 1,4-butanediol; glycerol; 1,1,1-trimethylol propane; pentaerythritol and polyethylene glycols may also be used. Triglycidyl isocyanurate; and polyglycidyl thioethers of polyvalent thiols, for example of bis-mercaptomethylbenzene; and diglycidyltrimethylene sulfone, are also suitable as the epoxy resin component.

As is known, epoxy resin adhesives are generally available for use in the form of a one-part system or in the form of a two-part system, and each of such systems are adaptable for use in accordance with the present invention. In two-part systems, a first part of the composition contains the epoxy resin and is mixed with a curing agent, sometimes also referred to as a hardener, just prior to use of the adhesive. As a result, the epoxy resin undergoes crosslinking polymerization and forms a cured, hardened adhesive. Heat or other forms of energy may be used to enhance or speed cure in such two-part systems, although this is not generally required. In one-part systems, the reactive adhesive is cured by exposure to heat, UV radiation or some other appropriate source of energy, or in the case of anaerobic systems, by the deprivation of oxygen from the system.

It is preferred that the curing agents of the present comprise aliphatic amines, anhydrides, polyamides, phenol/urea/melamine formaldehydes, Lewis acid catalysts, and combinations of two or more of these.

The curing agent of the present invention may include ambient temperature curing agents, latent intermediate temperature curing agents, latent high temperature curing agents, and combinations of one or more of these. Ambient temperature curing agents are agents reactive to catalyze crosslinking under ambient conditions, while latent high temperature curing agents are compounds or compositions which remain relatively inert up to temperatures of about 300° F. but at temperatures above about 300° F. are capable of rapidly catalyzing the crosslinking of the epoxy component. As used herein, the term "latent intermediate temperature curing agent" refers to compounds or compositions which remain generally unreactive up to temperatures of between about 100° F.–150° F. but which become reactive at temperatures of above about 150° F.

The curable adhesive compositions of this invention may also contain other additives such as fillers, pigments, diluents and dyes or the like added to provide desired properties. Suitable filler for use in the compositions of this invention are mineral fillers. Illustrative examples include: talc, mica, titanium dioxide, lithopone, zinc oxide, zirconium, silica, silica aerogel, iron dioxide, diatomaceous earth, calcium carbonate, fumed silica, silazane treated silica, precipitated silica, glass fibers, magnesium oxide, chromic oxide, zirconium oxide, aluminum oxide, crushed quartz, calcined clay, asbestos, carbon, graphite, cork, cotton, synthetic fibers, to name but a few. A particularly preferred filler is a fumed silica which also acts as a thixotropic agent and/or a compatibalizer, such as is sold under the trade name Cab-O-Sil TS-720. Another preferred filler for use herein comprises a mixture of alumina, silica, and iron in the form of hollow spheres, which is available under the tradename Fillite 500 sold by the Fillite division of Boliden Intertrade Inc. It is highly preferred to use a fumed silica when Fillite-like material is also used since applicants have found that such a mixture helps prevent separation of the hollow spheres from the composition.

The preferred amount of filler will generally depend upon the particular type of adhesive being used, as indicated hereinafter. Generally, the other additives such as dyes, diluents, pigments, thixotropic agents and the like will be added in conventional amounts. However, applicants have found that preferred non-reactive diluents, such as benzyl alcohol, can be added in amounts of about 4% to about 8% by weight of the composition without a significant detrimental effect on adhesive properties.

For embodiments in the form of one-part epoxy adhesives, the compositions preferably include intermediate and/or high temperature curing agents, but preferably do not include ambient curing agents since such materials would destroy the necessary storage stability of such systems. On the other hand, two-part systems will generally include ambient curing agents and may also include intermediate and/or high temperature curing agents. Accordingly, preferred formulations for each of these types of epoxy adhesives is disclosed below.

1. One-Part Epoxy Adhesives

According to certain embodiments, the epoxy adhesive hereof is formulated in a one-part storage stable system. As used herein, the term storage stable generally refers to systems which are substantially stable at temperatures of about 25° C. In such embodiments, the adhesive preferably comprises from about 20 to about 30 PBW of epoxy resin and from about 8 to about 20 PBW of curing agent, and even more preferably from about 20 to about 25 PBW of epoxy resin, from about 8 to about 13 PBW of curing agent and from about 50 to about 60 PBW of filler. The preferred curing agent comprises a combination of latent high temperature and latent intermediate temperature curing agents, with the weight ratio of the latent high temperature to latent intermediate agent preferably being from about 1:1 to about 4:1.

A preferred latent high temperature curing agent is dicyandiamide (DICY). DICY is a preferred latent high temperature curing agent because it is inexpensive, exhibits excellent latency at temperatures below 300° F. and exceptional catalytic activity at higher temperatures to provide excellent final cure properties. DICY is abundantly commercially available, and a preferred source is available under the tradename Ancamine CG 1400 sold by Anchor Chemical Co. Other known latent high temperature curing agents such as diaminodiphenylsulfone or DICY analogues might also be used.

A preferred latent intermediate temperature curing agent comprises modified aliphatic amines. Two such products are sold under the tradenames Ancamine CG 4014AS and Ancamine 2337XS, each sold by Anchor Chemical Co.

The preferred curing agent for use in the one-part systems of the present invention also preferably includes a reactive diluent comprising glycidyl neodeconate sold under the tradename CADURA E-10 sold by Shell Oil.

For embodiments in which latent high temperature curing agent is used, the accelerators which lower the reaction temperature of the agent may also be used if cure temperatures are expected to be less than 300° F. Careful selection of a high temperature curing agent accelerator must be made because addition of accelerators to lower cure temperature for the DICY may also disadvantageously shorten shelf life stability of the adhesive.

According to especially preferred embodiments of the present invention, the reactive, one-part epoxy adhesive comprises an induction curable reactive adhesive. In induction curing methods, low frequency electromagnetic radiation is used to provide very fast localized heating in the metal portions of the marker and/or to ferromagnetic particles in the adhesive as a means for curing the adhesive. Energy requirements for induction heating are relatively low compared to other methods of heating. Moreover, the speed with which heating is accomplished, e.g. 25–40 seconds to reach metal temperatures of about 100° C. to about 200° C., makes such a method particularly desirable for curing the reactive adhesives used in the present surface marking systems.

The filler component of the induction curable, one-part epoxy adhesives of the present invention preferably comprise, and even more particularly consists essentially of ferromagnetic particles as an aid to the rapid heating of the adhesive to curing conditions. According to especially preferred embodiments, such particles are present in the adhesive in an amount of from about 200 to about 320 parts per hundred by weight of resin (PHR), and even more preferably 225 to about 250 PHR. The ferromagnetic particulate preferably comprises aluminum oxide powder, such as the material sold under the tradename Electroox sold by Electro Abrasives, Buffalo, N.Y.

In general, the one-part, induction curable, epoxy adhesive compositions of the present invention are prepared by mixing the epoxy resin with the curing agent, the ferromagnetic particles and any other additives.

2. Two-Part Epoxy Adhesives

The preferred two-part epoxy adhesive comprises a first part (hereinafter referred to for convenience as "Part A") comprising epoxy resin and a second part (hereinafter referred to for convenience as "Part B") comprising the curing agent and filler. In such embodiments, Part A preferably comprises from about 60 to about 90 PBW of epoxy resin and from about 10 to about 40 PBW of filler, and even more preferably from about 20 to about 40 PBW of epoxy resin and from about 10 to about 20 PBW of filler.

Part B of the two-part adhesive compositions comprises curing agent. The preferred curing agent comprises an ambient temperature curing agent, an even more preferably a mixture of amino ethyl piperazine and nonyl phenol, available under the tradename Ancamine 2205 sold by Anchor Chemical Co. and a nonyl phenol available form GE Specialty Chemical Co. According to certain preferred embodiments, Part B also comprises filler. The amount of Part B in the present compositions is preferably about 100 parts by weight and/or by volume per 100 parts of part A.

II. METHODS OF FORMING MARKING SYSTEMS

The present invention also provides methods of forming marking systems, and preferably marking systems for traffic bearing surfaces. The methods generally comprise the steps of (a) providing a portion of the surface which is adapted to adhesively mount the marker; (b) providing a curable, resin-based adhesive composition between said road surface portion and at least a portion of the marker; and (c) curing the composition to form a cured composition adhesively bonding the surface marker to the surface. An important and critical aspect of the forming methods is the use of an adhesive in accordance with the present invention, namely, an adhesive having a lap shear strength of at least about 1000 psi at about 22° C. and a lap shear strength of about 500 psi or less at at least one temperature in the temperature range of from about 70° C. to about 180° C.

Applicant's have found that unexpected and beneficial results are achievable with the use of heat curable compositions, and even more preferably induction curable compositions. More particularly, the curing step hereof preferably comprises raising the temperature of the adhesive composition to temperatures of from about 100° C. to about 200° C. It is contemplated that the curing step may include any one or more of several known techniques, depending in large part on the particular adhesive being used. For embodiments which utilize a two-part epoxy adhesive, the curing step generally involves allowing the adhesive to cure under ambient temperature conditions for a period of from about 24 hours to about one week. Of course, even in such embodiments the cure time can generally be reduced by heating the composition to a temperature of from about 50° C. to about 150° C., preferably by induction heating of the marker and/or ferromagnetic particles in the adhesive. Applicants have found that in such cases, the cure time can be reduced to about 30–120 seconds.

For embodiments which utilize a one-part epoxy adhesive, the curing step preferably comprises heating the composition to a temperature of from about 50° C. to about 150° C., preferably by induction heating of the marker and/or ferromagnetic particles in the adhesive. Applicants have found that in the case of induction curing, the cure time can be reduced to about 40 to about 60 seconds by induction heating the composition to temperatures of from about 100° C. to about 150° C.

As is known to those skilled in the art of installing marking systems for roadways and like surfaces, the time required to install such systems is of critical importance. For example, such marking systems are frequently installed on existing roadways which experience heavy traffic patterns. In order to install the markers in the road surface, it is commonly necessary to either close the roadway to traffic or to reroute traffic in order to accommodate installation of the marking system. In either case, the negative effect on the user of the roadway surface is significant. As a result, the ability to install such marking systems in the shortest possible time period is highly desirable and advantageous. Applicants have discovered that embodiments of the present invention in which the curing step comprises induction curing of the adhesive are highly advantageous since rapid and effective curing cycles can thereby be obtained.

The effectiveness of the preferred marking systems is such that the pullout force of the cured systems at ambient conditions (eg., 25° C.) is at least about 2000 psi, more preferably at least about 4000 psi, and even more preferably at least about 8000 psi.

As is known to those skilled in the art, the basic principle of induction heating is that the flow of an electric current through a conductive material results in a rise in the temperature of that conductive material. Accordingly, induction heating involves the creation of an electrical current flow in a conductive material such that the resistance to such current flow creates a desired amount of heat. In induction heating operations, an electrical conductor, typically in the form of a wound coil, is utilized to produce a magnetic field in the vicinity surrounding the coil. The magnetic field produced by these inductor coils, when properly placed and positioned with respect to the metallic material to be warmed, produces an electron flow in such material.

Applicants have discovered that several parameters which influence the nature and characteristics of the induction heating process are of critical importance to certain embodiments of the present methods. More particularly, applicants have found that methods involving the use of metallic markers in roadway marking systems are significantly and unexpectedly more effective when low frequency induction curing is utilized. More specifically, it is highly preferred in such embodiments that the induction curing step comprise induction curing at a frequency of less than about 20 KHz, more preferably from about 10 KHz to about 18 KHz, and even more preferably of from about 10 KHz to about 12 KHz. According to certain embodiments, frequencies as low as 5 KHz may be employed. Although applicants do not necessarily wish to be bound by or limited to any particular theory of operation, it is believed that the physical configuration of typical roadway markers substantially reduces the effectiveness of induction curing using high frequency induction systems. More particularly, such markers typically incorporate steel sections that are ½ thick or greater. It is believed that such configurations substantially prevent the use of effective induction curing techniques in the high frequency range.

III. METHODS OF REMOVING MARKERS FROM MARKING SYSTEMS

The present invention also advantageously provides methods of removing markers from marking systems. The methods generally comprise the steps of (a) providing a surface having a marker bonded thereto by an adhesive composition; (b) heating the adhesive to a temperature effective to substantially reduce the bond strength of the adhesive; and (c) removing the marker from the surface.

According to a especially preferred embodiments, the step of heating the adhesive composition comprises induction heating the composition to a temperature effective to substantially reduce the strength of the adhesive. Applicants have thus surprisingly and unexpectedly found that induction heating can be beneficially employed to effectively, quickly and economically debond the adhesive in such marker systems. As discussed above with respect to the advantage of quick curing adhesive compositions, the ability to quickly debond the adhesive in the present marking systems is likewise highly advantageous. According to especially preferred embodiments of these method aspects, the heating step comprises induction heating of the cured adhesive to a temperature of from about 120° C. to about 140° C., and even more preferably of from about 130° C. to about 140° C. Furthermore, it is preferred that the heating step comprise raising the temperature of the cured adhesive to within the above specified temperature ranges in a time period of less than about 130 seconds, more preferably from about 80 seconds to about 120 seconds, and even more preferably of from about 80 to about 90 seconds.

For embodiments in which: (1) the surface is a roadway surface; (2) the marker is marker containing substantial metallic portions; and (3) the adhesive is a cured adhesive in accordance with the present invention, it is preferred that the heating step comprise heating the cured adhesive composition to a temperature of less than about 130° C. so as to substantially reduce the pullout force of said marker. In such embodiments, it is especially preferred that the induction heating step comprise low frequency induction heating so as to reduce the pullout force of the marker from a value greater than about 2000 lbs. to a value less than about 1000 lbs. and a time of less than about 100 seconds, and even more preferably from about 70 to about 80 seconds.

As used herein, the term "pullout force" refers to the force required to remove an installed marker from a road surface is measured in accordance with the following parameters. A road surface marker is embedded and bonded according to manufacturers instructions in a test block of concrete about 15 inch×10.5 inch×5.5 inch using about 290 cubic centimeters of curable adhesive. After heating to attain raise cured adhesive temperature to the specified value, the amount of force required to remove the marker from the block is measured to determine the pullout force.

IV. EXAMPLES

Example 1

Two-Part Reactive Adhesive

A reactive, two-part, epoxy adhesive composition was prepared for use in connection with forming a roadway surface marking system according to the present invention. The adhesive had the following formulation in parts by weight (PBW):

TABLE 1

| Epoxy Adhesive | |
|---|---|
| Component | PBW |
| Part A | |
| Epoxy Resin (Epon 8280) | 81 |
| Filler (Fillite 500) | 16 |
| Pigment | 2.4 |
| Wetting Agent | 0.4 |
| Part B | |
| Aliphatic Amine (Ancamine 2205) | 41.5 |
| Nonyl Phenol | 41.5 |
| Filler (Fillite) | 16.6 |
| Wetting Agent (BYK 555) | 0.4 |

The adhesive was evaluated and found to have a pot life of about 7 minutes and a functional cure time under ambient conditions of about 1.5 hours. The viscosity of part A of the resin was measured to be about 92,000 centipoise @ 25° C. and the viscosity of Part B was measured to be about 130,000 centipoise @ 25° C. The lap shear strength of the adhesive was measured in accordance with ASTM-D 1002 and found to have the strength properties identified in Table 1B below and illustrated as the curve labeled E1 in FIG. 4.

TABLE 1B

| Lap Shear Strength | |
|---|---|
| Temperature, C. | PSI |
| −40 | 1000 |
| 25 | 1000 |
| 150 | 50 |
| 180 | 20 |

Example 2

One-Part Reactive Adhesive

A reactive, one-part, epoxy adhesive composition was prepared for use in connection with forming a roadway surface marking system according to the present invention. The adhesive had the following formulation:

TABLE 2

| Epoxy Adhesive | |
|---|---|
| Component | PBW |
| Epoxy Resin (Epon 828) | 22.27 |
| Aliphatic Amine (Ancamine 2014AS) | 6.49 |
| DICY (Ancamine CG1400) | 1.66 |
| Aliphatic Amine (Ancamine 2237XS) | 4.76 |
| Glycidyl neodeconate (Cadura E-10) | 7.42 |
| Filler (AlO2 powder) | 57.4 |

The adhesive was evaluated and found to have a functional cure time of about 30 min. at temperatures of about 280° F. The viscosity of the adhesive was about 50,000–100,000 centipoise @ 25° C. The lap shear strength of the adhesive was measured in accordance with ASTM-D 1002 and found to have the strength properties identified in Table 2B below and illustrated as the curve labeled E2 in FIG. 4.

TABLE 2B

| Lap Shear Strength | |
|---|---|
| Temperature, C. | PSI |
| −40 | — |
| 24 | 1480 |
| 38 | 1480 |
| 70 | 1620 |
| 106 | 250 |
| 120 | 120 |

Example 3

One-Part Reactive Adhesive

A reactive, one-part, epoxy adhesive composition was prepared for use in connection with forming a roadway surface marking system according to the present invention. The adhesive had the following formulation:

TABLE 3A

| Epoxy Adhesive | |
|---|---|
| Component | PBW |
| Epoxy Resin (Epon 828) | 23.39 |
| Aliphatic Amine (Ancamine 2014FG) | 6.82 |
| DICY (Ancamine CG1400) | 1.75 |
| Glycidyl neodeconate (Cadura E-10) | 7.80 |
| Filler (AlO2 powder) | 60.24 |

The adhesive was evaluated and found to have a functional cure time of about 90 min. at temperatures of about 25° C. The viscosity of the adhesive was measured to be about 75,000 centipoise @ 25° C. The lap shear strength of the adhesive was measured in accordance with ASTM-D 1002 and found to have the strength properties identified in Table 3B below and illustrated as the curve labeled E2 in FIG. 4.

TABLE 3B

| Lap Shear Strength | |
|---|---|
| Temperature, C. | PSI |
| −40 | — |
| 24 | 1530 |
| 38 | 1938 |
| 70 | 1088 |
| 106 | 576 |
| 120 | — |

Example 4

Surface Marking System

A surface marking system was prepared utilizing each of the adhesives identified in Examples 1—3. Each system consisted of a road surface marker available from the Stimsonite Corporation under the trade designation Model 98 embedded in a concrete block in accordance with the pull-out force technique described above. The induction conditions used for each sample is set forth in Table 4A below:

TABLE 4A

| Curing Conditions | | | |
|---|---|---|---|
| | Adhesive | | |
| Induction conditions | E1 | E2 | E3 |
| Temperatures, °C. | | | |
| Marker Top Surface | 125–145 | 80–100 | 90–100 |
| Marker Bottom Surface | 50–70 | 30–45 | 60–70 |
| Power, KW | 5 | 5 | 5 |
| Frequency, KHz | 12 | 12 | 12 |
| Time, sec | 40 | 20 | 30 |

After allowing the adhesive to set for about 48 hours, the marker pull-out force was measured at ambient conditions (25° C.) and found to be as follows in Table 4B for each adhesive:

TABLE 4B

| Ambient Pull Out Force | |
|---|---|
| Example Adhesive | PSI |
| 1 | ≧4000 |
| 2 | ≧4000 |
| 3 | ≧4000 |

Each marker was then debonded in accordance with the present invention. More specifically, debonding was achieved by heating the adhesive using induction heating conditions to produce pull-out force values as indicated in Table 4C below:

TABLE 4C

| Debonding | | | |
|---|---|---|---|
| | Adhesive | | |
| Induction Conditions | E1 | E2 | E3 |
| Temperatures, °C. | | | |
| Marker Top Surface | 213 | 198 | 210 |
| Marker Bottom Surface | 130 | 121 | 125 |
| Power, KW | 5 | 5 | 5 |
| Frequency, KHz | 12 | 12 | 12 |
| Time, sec | 80 | | 80 |
| Pull Out Force, pounds | 330 | 370 | 400 |

Example 5

Low Cost, Two-Part Reactive Adhesive

A reactive, two-part, epoxy adhesive composition was prepared for use in connection with forming a roadway surface marking system according to the present invention. The adhesive had the following formulation in parts by weight (PBW):

TABLE 5

| Epoxy Adhesive | |
|---|---|
| Component | PBW |
| Part A | |
| Epoxy Resin (Epon 828) | 81 |
| Filler (Fillite 500) | 16 |
| Pigment | 2.4 |
| Wetting Agent (BYK 555) | 0.4 |
| Part B | |
| Aliphatic Amine (Ancamine 2205) | 41.5 |
| Nonyl Phenol | 41.5 |
| Filler (Fillite) | 16.6 |
| Wetting Agent (BYK 555) | 0.4 |

The lap shear strength, cure time and pullout force of this system are similar the values described in Example 1.

Example 6

Low Cost, High Strength, Two-Part Reactive Adhesive

A reactive, two-part, epoxy adhesive composition was prepared for use in connection with forming a roadway surface marking system according to the present invention. The adhesive had the following formulation in parts by weight (PBW):

TABLE 6

| Epoxy Adhesive | |
|---|---|
| Component | PBW |
| Part A | |
| Epoxy Resin (Epon 828) | 75 |
| Filler (Fillite 500) | 16.2 |
| Pigment | 1 |
| Wetting Agent (BYK 555) | 0.4 |
| Non-reactive Diluent (Benzyl Alcohol) | 6.4 |
| Thixotropic Agent (Cab-O-Sil TS-720) | 1 |
| Part B | |
| Amino Ethyl Piperazine | 19.2 |
| Nonyl Phenol | 57.7 |
| Filler (Fillite) | 22.1 |
| Thixotropic Agent (Cab-O-Sil TS-720) | 1 |

The adhesive was evaluated and found to have a pot life of about 8 minutes and was curable under ambient conditions. The viscosity of part A of the resin was measured to be about 28,800 centipoise @ 25° C. and the viscosity of Part B was measured to be about 35,000 centipoise @ 25° C. The lap shear strength of the adhesive was measured in accordance with ASTM-D 1002 and found to have the strength properties identified in Table 6B below.

TABLE 1B

| Lap Shear Strength | |
|---|---|
| Temperature, C. | PSI |
| −40 | 2026 |
| 25 | 1960 |
| 65 | 300 |
| 150 | 127 |
| 180 | 113 |

Moreover, the pullout force of this adhesive was tested and found to be about 8000 psi.

What is claimed is:

1. A surface marking system comprising:

(a) a surface;

(b) a marker embedded in the surface; and (c) an adhesive composition comprising cured resin adhesively bonding said marker to said surface, said adhesive having a lap shear strength of at least about 1000 psi over the entire temperature range of from about −40° C. to about 50° C. and a lap shear strength of about 500 psi or less at at least one temperature in the temperature range of from about 70° C. to about 180° C.

2. The system of claim 1 wherein said cured resin comprises cured epoxy resin.

3. The system of claim 1 wherein said cured resin is formed from an induction curable composition comprising epoxy resin.

4. The system of claim 3 wherein said cured resin is formed from a storage stable, induction curable, one-part composition comprising epoxy resin.

5. The system of claim 3 wherein said cured resin is formed from an induction curable, two-part composition comprising epoxy resin.

6. The system of claim 5 wherein said adhesive has a lap shear strength of about 2000 psi at about 25° C. and a lap shear strength of 300 psi or less at temperatures above about 65° C.

7. The system of claim 5 wherein said cured resin is formed from a reactive adhesive wherein a first part of said two-part composition comprises about 60 to about 90 PBW epoxy resin and a second part of said two-part composition comprises about 100 PBW curing agent.

8. The system of claim 7 wherein said first part further comprises from about 10 PBW to about 40 PBW of filler.

9. The system of claim 3 wherein said cured resin is formed from a reactive adhesive comprising about 20 to about 30 PBW of epoxy resin and about 8 to about 20 PBW of curing agent.

10. The system of claim 1 wherein:

(i) said marker comprises a surface marker having a bottom portion embedded in the surface and a top portion visible from the surface; and (ii) said cured adhesive composition is between said bottom portion of said marker and said surface.

11. The system of claim 1 wherein said cured adhesive composition has a lap shear strength of at least about 2000 psi at about 25° C. and a lap shear strength of about 250 psi or less at at least one temperature in the temperature range of from about 70° C. to about 150° C.

12. The system of claim 1 comprising a roadway surface marking system in which said marker includes indicia to be sensed by users of the roadway.

13. The system of claim 1 or claim 12 wherein said adhesive composition has a lap shear strength of at least about 1000 psi at temperatures of from about −40° C. to about 50° C. and a lap shear strength of about 250 psi or less at at least one temperature in the temperature range of from about 70° C. to about 150° C.

14. The system of claim 1 or 12 wherein said adhesive composition has a lap shear strength of about 250 psi or less in the temperature range of from about 70° C. to about 150° C.

15. The system of claim 1 or claim 12 wherein the pull-out force of said marker is at least about 2000 pounds at about 25° C. and about 1000 pounds or less at at least one temperature in the temperature range of from about 50° C. to about 150° C.

16. The system of claim 1 wherein said cured resin is formed from a reactive adhesive comprising about 20 to about 38 PBW epoxy resin and about 8 to about 40 PBW curing agent.

17. A surface marking system comprising:

(a) a surface;

(b) a marker embedded in the surface; and (c) an adhesive composition comprising cured epoxy resin adhesively bonding said marker to said surface, said cured epoxy adhesive having a lap shear strength of at least about 1000 psi over the entire temperature range of from about −40° C. to about 50° C. and a lap shear strength of about 500 psi or less at least one temperature in the temperature range of from about 70° C. to about 180° C.

18. The system of claim 17 wherein said cured epoxy adhesive is formed from an induction curable epoxy resin.

19. The system of claim 17 wherein said cured epoxy adhesive is formed from a storage stable, induction curable, one-part epoxy resin.

20. The system of claim 17 wherein said epoxy resin is a prepolymer selected from the group consisting of polyglycidyl ethers of polyvalent phenols, polyglycidyl ethers of novalacs, polyglycidyl ethers of diphenols, polyglycidyl ethers of polyphenols, and combinations of two or more of these.

21. The system of claim 20 wherein said polyglycidyl ether of polyvalent phenols is selected from the group consisting of pyrocatechol; resorcinol; hydroquinone; 4,4'-dihydroxydiphenyl methane; 4,4'-dihydroxy-3-3'-dimethyldiphenyl methane; 4,4'-dihydroxydiphenyl dimethyl methane; 4,4'-dihydroxydiphenyl methyl methane; 4,4'-dihydroxydiphenyl cyclohexane; 4,4'-dihydroxy-3,3'-dimethyldiphenyl propane; 4,4'-dihydroxydiphenyl sulfone; tris-(4-hydroxyphenyl)methane; and combinations of two or more of these.

22. The system of claim 17 wherein said cured epoxy adhesive is formed from an induction curable, two-part epoxy resin.

23. The system of claim 17 wherein said adhesive composition has a lap shear strength of about 250 psi or less in the temperature range of from about 70° C. to about 150° C.

* * * * *